US011877665B2

(12) United States Patent
Chen et al.

(10) Patent No.: US 11,877,665 B2
(45) Date of Patent: Jan. 23, 2024

(54) ANTI-RADIATION MOSQUITO NET

(71) Applicant: Shandong EMF New Material Technology Co., Ltd., Jinan (CN)

(72) Inventors: Shikun Chen, Heze (CN); Xiangling Wang, Heze (CN)

(73) Assignee: Shandong EMF New Material Technology Co., Ltd., Jinan (CN)

( * ) Notice: Subject to any disclaimer, the term of this patent is extended or adjusted under 35 U.S.C. 154(b) by 603 days.

(21) Appl. No.: 17/117,509

(22) Filed: Dec. 10, 2020

(65) Prior Publication Data

US 2021/0177157 A1 Jun. 17, 2021

(30) Foreign Application Priority Data

Dec. 16, 2019 (CN) ..... 201911293793.X

(51) Int. Cl.
*A47C 29/00* (2006.01)
*A47C 31/00* (2006.01)

(52) U.S. Cl.
CPC ..... *A47C 29/006* (2013.01); *A47C 31/004* (2013.01); *A47C 31/007* (2013.01)

(58) Field of Classification Search
CPC ..... A47C 29/00; A47C 29/003; A47C 29/006; A47C 31/004; A47C 31/007
See application file for complete search history.

(56) References Cited

U.S. PATENT DOCUMENTS

| | | | | |
|---|---|---|---|---|
| 9,332,855 | B2 * | 5/2016 | Baxter | A47C 27/002 |
| 2020/0268164 | A1 * | 8/2020 | Jimenez Castillo | A47C 27/002 |
| 2023/0248157 | A1 * | 8/2023 | Schwarzhans | E04B 1/92 174/378 |

FOREIGN PATENT DOCUMENTS

| | | | |
|---|---|---|---|
| CA | 2856236 | A1 * | 1/2016 |
| CN | 105310345 | A * | 2/2016 |
| CN | 105982465 | A * | 10/2016 |
| CN | 214678386 | U * | 11/2021 |

* cited by examiner

*Primary Examiner* — Noah Chandler Hawk
(74) *Attorney, Agent, or Firm* — Bay State IP, LLC

(57) ABSTRACT

An anti-radiation mosquito net includes a mosquito net body and a grounding connection device, wherein the mosquito net body is made of silver fibers and has a dense mesh structure; the grounding connection device is connected with the mosquito net body; and the grounding connection device is connected with a socket to lead static electricity of the mosquito net body into the ground. The mosquito net body has a dense net structure made of silver fibers, which has good conductivity, can better shield electromagnetic radiation and protect human body from electromagnetic wave interference; and when the grounding connection device of the mosquito net body is connected with the socket, the functions of anti-electromagnetic radiation and anti-static electricity can be enhanced by leading charges into the ground; according to the physiological process that silver fibers block bacteria, the mosquito net body can play a high-strength antibacterial role at the same time.

7 Claims, 5 Drawing Sheets

ANTI-RADIATION MOSQUITO NET

CROSS REFERENCE TO RELATED APPLICATION

This application claims the benefit of and takes priority from Chinese Patent Application No. 201911293793.X filed on Dec. 16, 2019, the contents of which are herein incorporated by reference.

TECHNICAL FIELD

The present invention relates to the technical field of mosquito nets, and in particular to an anti-radiation mosquito net.

BACKGROUND OF THE INVENTION

Usually, mosquito nets are curtains used to hang on bedsteads and prevent mosquito bites, and can also absorb dust in the air.

Nowadays, people are pursuing higher and higher quality of life. The applicant finds that the prior art has at least the following technical problems: with the progress of modernization and the update of science and technology, radiation, static electricity and bacteria have penetrated people's lives seamlessly. People still receive radiation from various indoor electronic products for a long time when they rest at night, especially for special groups such as pregnant women, who can no longer wear anti-radiation maternity clothes when they sleep at night. The quality of rest in bed for people, including sleep quality, is greatly reduced.

At present, there is no better way to prevent radiation, static electricity and living bacteria from harming people's health.

SUMMARY OF THE INVENTION

The purpose of the present invention is to provide an anti-radiation mosquito net to solve the technical problem that the conventional mosquito net cannot isolate the radiation of electronic products in the prior art; many technical effects produced by the preferred technical scheme among the technical schemes provided by the present invention are described in detail hereinafter.

To achieve the above purpose, the present invention provides the following technical scheme:

The present invention provides an anti-radiation mosquito net, comprising a mosquito net body and a grounding connection device, wherein:

the mosquito net body is made of silver fibers and has a dense mesh structure, the grounding connection device is connected with the mosquito net body, and the grounding connection device is connected with a socket to lead static electricity of the mosquito net body into the ground.

Preferably, the grounding connection device comprises a conductive gasket, a connecting wire and a grounding plug connected with the socket, wherein the conductive gasket is detachably connected with the mosquito net body, and the connecting wire is detachably connected with the conductive gasket.

Preferably, the conductive gasket and the connecting wire are fastened and connected.

Preferably, a fixing part is provided at the connection between the connecting wire and the grounding plug, a first fastener is provided on the fixing part, a second fastener adapted to the first fastener is provided on the conductive gasket, and the first fastener and the second fastener can be fastened and fixed with each other and are made of conductive materials.

Preferably, a resistance device is provided on the connecting line.

Preferably, the grounding connection device comprises a grounding plug for connecting the mosquito net body and the socket, and the grounding plug comprises a grounding terminal for grounding static electricity, and a live wire pin and a neutral wire pin made of non-conductive materials.

Preferably, the grounding connection device comprises a first plug part connected with the mosquito net body and a second plug part adapted to sockets of different models, wherein:

a tab component connected with a grounding pin or a grounding plate thereon via a wire is provided in the second plug part, a jack allowing the first plug part to be inserted is provided on the shell of the second plug part, and the first plug part is capable of being electrically connected with the tab component after being inserted into the jack.

Preferably, the first plug part is an American-standard plug, and the second plug part is one or more of a European-standard plug, an English-standard plug and a Chinese-standard plug.

Preferably, a plurality of jacks are provided on the second plug part, and all the jacks are electrically connected with the tab component;

the tab component is located at a position corresponding to the jack in the second plug part, and an accommodation space allowing the first plug part to extend is formed on the tab component.

Preferably, the conductive gasket is fixedly clamped on the mosquito net body by a fixing clip or sewed on the mosquito net body.

Compared with the prior art, the anti-radiation mosquito net provided by the present invention has the following beneficial effects:

The mosquito net body has a dense mesh structure made of silver fiber. According to the characteristics of silver fibers, the silver fiber mosquito net has good conductivity, and the manufactured mosquito net can better shield electromagnetic radiation; according to the conductive characteristics of silver fibers, when static electricity is generated around, the mosquito net body discharges the charge to achieve the effect of static electricity release, protecting human body from electromagnetic wave interference (can protect fetus in abdomen of pregnant women from electromagnetic wave pollution); and when the grounding connection device of the mosquito net body is connected with the socket, the functions of anti-electromagnetic radiation and anti-static electricity can be enhanced by leading charges into the ground.

According to the physiological process that silver fibers block bacteria, the mosquito net body can play a high-strength antibacterial role at the same time, further improving the sleeping quality of human body.

BRIEF DESCRIPTION OF THE DRAWINGS

In order to explain the embodiments of the present invention or the technical scheme in the prior art more clearly, the drawings required in the embodiments or the description of the prior art will be briefly introduced hereinafter. Obviously, the drawings in the following description are only some embodiments of the present invention, and other drawings can be obtained according to these drawings for those skilled in the art without paying creative labor.

Figure 1:
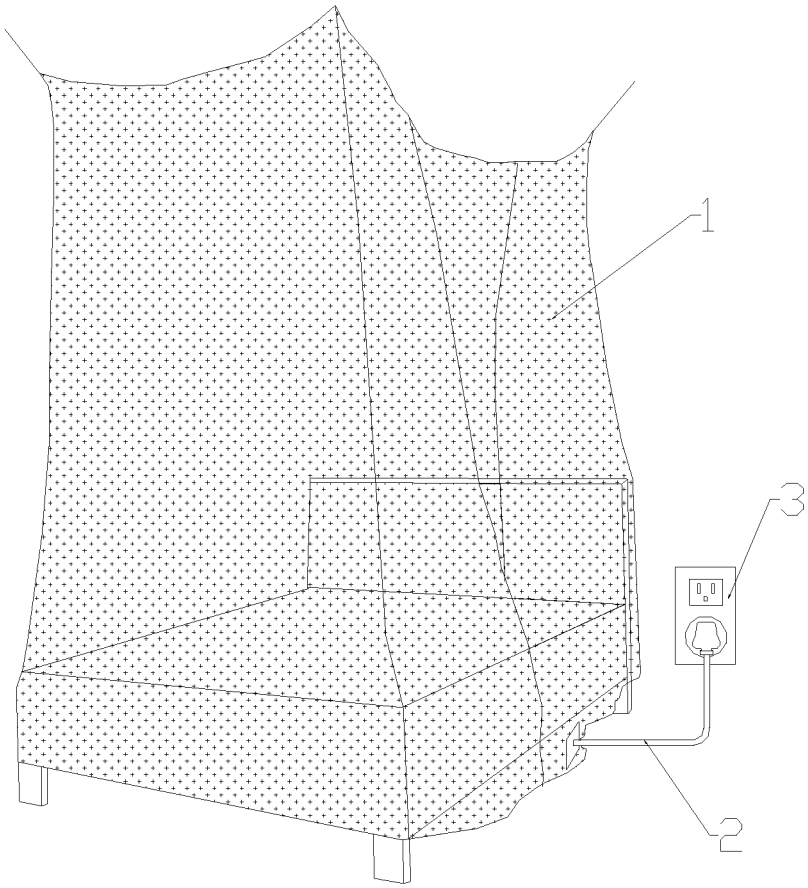
FIG. 1 is a schematic structural diagram of an anti-radiation mosquito net according to the present invention.

In the figures, 1. Mosquito net body; 2. Grounding connection device; 21. Conductive gasket; 22. Connecting wire; 23. Grounding plug; 2311. First plug part; 2312. Second plug part; 211. Second fastener; 231. Metal part; 232. Plastic part; 24. Fixing part; 241. First fastener; 25. Fixing clip; 3. Socket; 4. Jack; 5. Tab component; 51. Accommodation space.

DETAILED DESCRIPTION OF THE SEVERAL EMBODIMENTS

In order to make the purpose, technical scheme and advantages of the present invention clearer, the technical scheme of the present invention will be described in detail hereinafter. Obviously, the described embodiments are only some embodiments of the present invention, rather than all of the embodiments. Based on the embodiments of the present invention, all other embodiments obtained by those skilled in the art without paying creative labor belong to the scope of protection of the present invention.

In the description of the present invention, it should be understood that the directions or positional relationships indicated by the terms "center", "length", "width", "height", "upper", "lower", "front", "rear", "left", "right", "vertical", "horizontal", "top", "bottom" "inner", "outer", "side", etc. are based on the directions or positional relationships shown in the drawings, which are only for the convenience of describing the present invention and simplifying the description, rather than indicate or imply that the referred device or element must have a specific direction, be constructed and operated in a specific direction, and therefore cannot be understood as limiting the present invention. In the description of the present invention, unless otherwise specified, "a plurality of" means two or more.

Figure 2:
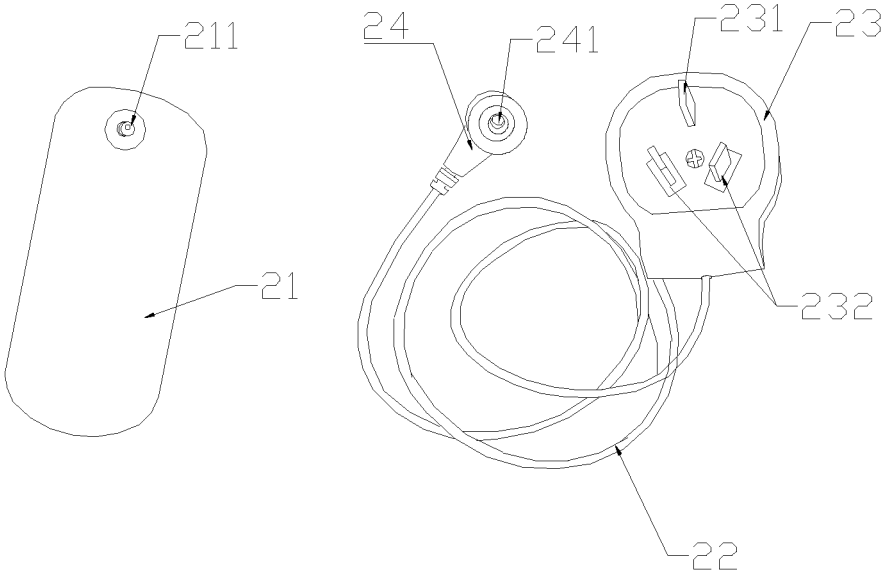
FIG. 2 is a structural schematic diagram of a grounding connection device.
Figure 3:
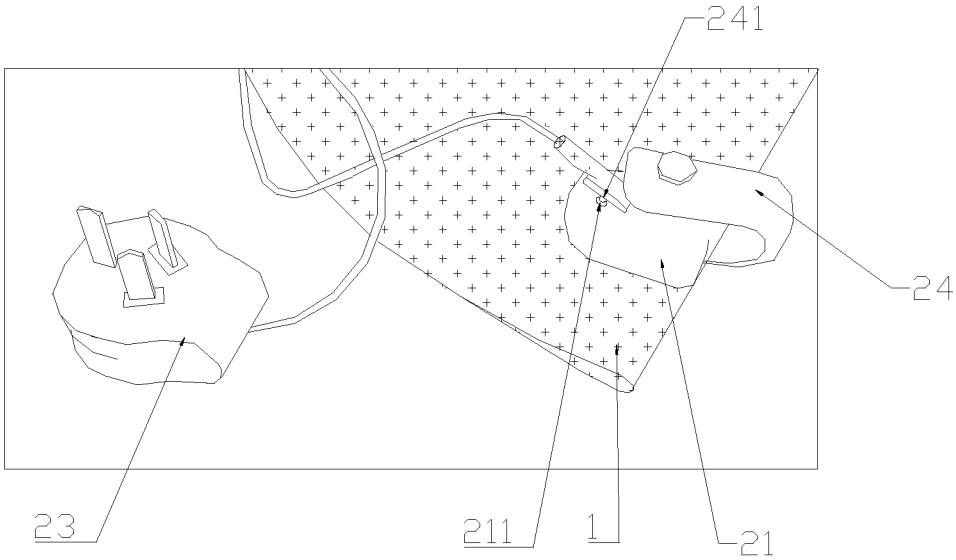
FIG. 3 is a schematic diagram of the connection between the grounding connection device and the mosquito net body according to one embodiment.

Referring to FIGS. 1-3, FIG. 1 is a schematic structural diagram of an anti-radiation mosquito net according to the present invention; FIG. 2 is a structural schematic diagram of a grounding connection device; FIG. 3 is a schematic diagram of the connection between the grounding connection device and the mosquito net body according to one embodiment.

The embodiment provides an anti-radiation mosquito net, comprising a mosquito net body 1 and a grounding connection device 2, wherein:

the mosquito net body 1 is made of silver fibers and has a dense mesh structure, the grounding connection device 2 is connected with the mosquito net body 1, and the grounding connection device 2 is connected with a socket 3 to lead static electricity of the mosquito net body 1 into the ground.

The mosquito net body 1 has a net structure made of silver fibers. When the mosquito net is square, round or in other shapes, silver has good conductivity, which is several times or even hundreds of times that of common conductive metals. The principle of conductivity and radiation resistance has excellent anti-radiation characteristics. The mosquito net body 1 made of silver fiber can better shield electromagnetic radiation and play a good role in protecting people resting therein. Especially for pregnant women, it can keep pregnant women away from electromagnetic radiation and prevent electromagnetic pollution when they rest at night.

On the other hand, according to the conductive characteristics of silver fibers, when static electricity is generated around, the body discharges charge to achieve the effect of static electricity release. In addition, the mosquito net body 1 is further connected with the grounding connection device 2. When the grounding connection device is connected with the socket 3, the charge existing on the mosquito net body 1 can be led into the ground, enhancing the effect of an electromagnetic radiation and anti-static electricity. When using the grounding connection device, the body the human body (when the mosquito net is in contact with the human body) and the ground are connected. Sleeping in such a mosquito net can make the positive and negative charges of human cells reach a balanced state, optimize the bioelectrical state of human body and improve the sleep quality of human body.

Furthermore, according to the physiological process that silver fibers block bacteria, that is, the biological activity of silver ions is mainly used to combine it with other substances, so that the proteins inside and outside the bacterial cell membrane are solidified, thus blocking the reproduction of bacteria and playing a high-strength antibacterial role.

Therefore, compared with the existing mosquito nets, the anti-radiation mosquito net provided in this embodiment has excellent anti-radiation, anti-static electricity and anti-bacteria properties, and can enhance the anti-radiation and anti-static electricity properties when connected with the grounding connection device, thus improving the sleeping quality of users to a certain extent.

Specifically, as shown in FIG. 1, the silver fiber mosquito net is soft. A overlapping liftable mosquito net member can be provided at the opening of the mosquito net FIG. 1 for the user to enter or fold the mosquito net; alternatively, the mosquito net can be closed or opened by providing a hook and loop fastener or a zipper at the opening of the mosquito net body 1. In addition, the mosquito net body 1 has a dense mesh structure, which can prevent mosquitoes and does not affect the use of original functions.

In order to facilitate the connection between the mosquito net body 1 and the grounding connection device and the socket 3, as an optional embodiment, as shown in FIGS. 2 and 3, the grounding connection device 2 comprises a conductive gasket 21, a connecting wire 22 and a grounding plug 23 connected with the socket 3, wherein the conductive gasket 21 is connected with the mosquito net body 1, and the connecting e 22 is detachably connected with the conductive gasket 21.

The above detachable connection method enables the mosquito net body 1 to be used with the grounding connection device or used alone, which is convenient for assembly and disassembly.

In order to facilitate the connection between the conductive gasket 21 and the connecting wire 22, as an optional embodiment, referring to FIGS. 2 and 3, the conductive gasket 21 and the connecting wire 22 are fastened and connected.

As an optional embodiment, referring to FIGS. 2 and 3, a fixing part 24 is provided at the connection between the connecting wire 22 and the grounding plug 23, a first fastener 241 is provided on the fixing part 24, a second fastener 211 adapted to the first fastener 241 is provided on the conductive gasket 21, and the first fastener 241 and the second fastener 211 can be fastened and fixed with each other and are made of conductive materials.

The connecting wire 22 is a wire. The fixing portion 24 is used to fix the first fastener 241 on the connecting wire 22. Specifically, as shown in FIG. 2, the first fastener 241 and the second fastener 211 can be matched snap fasteners.

It should be noted that the first fastening member 241 and the second fastening member 211 should be made of conductive materials. In specific use, the conductive gasket 21 is fixed on the mosquito net body 1. Preferably, the conductive gasket 21 is fixed on the lower part of the mosquito net body 1 to facilitate connection with the socket 3, and then the fixing part 24 on the connecting line 22 and the conductive gasket 21 are fastened. The second fastener 211 of the conductive gasket 21 is made of conductive material and is in contact with the mosquito net body 1. The electrostatic charge can be transmitted to the first fastener 241 through the second fastener 211, transmitted to the plug through the connecting line 22, and led underground through the socket 3.

As an alternative embodiment, a resistance device is provided on the connecting line 22.

Specifically, the resistance device can be provided in the fixing part 24 and connected with the connecting wire 22, and the resistance device can use resistance of 100 kΩ. The resistance device can adjust the resistance of the grounding connection line 22 to prevent the reverse breakdown effect caused by the current from the socket 3 or the ground. When the mosquito net is not in contact with human body, referring to the Faraday cage effect, grounding can lead the electric radiation magnetic field around the mosquito net to the ground through the grounding wire of the body, thus enhancing the functions of anti-radiation and anti-static electricity.

The grounding connection device comprises a grounding plug 23 for connecting the mosquito net body 1 and the socket 3, and the grounding plug 23 comprises a grounding terminal for grounding static electricity, and a live wire pin and a neutral wire pin made of non-conductive materials.

Since different countries often adapt to different types of grounding plugs, in order to improve the application range of the anti-radiation mosquito net in this embodiment, several embodiments of the grounding plug 23 are provided below.

Embodiment 1

The grounding terminal, the live wire pin and the neutral wire pin can be located on the same plug, as shown in FIG. 3, which shows an example of the Chinese-standard plug.

In order to facilitate the adaptation of the grounding plug 23 to the household three-hole socket 3, as an optional embodiment, as shown in FIG. 2, the grounding plug 23 is a three-pin plug, wherein the grounding pin is made of conductive materials, and the live pin and the zero pin are made of non-conductive materials.

In specific use, the grounding plug 23 can be inserted into the household three-hole socket 3. However, since the live wire pin and the neutral wire pin in the grounding plug 23 are made of non-conductive materials and are non-conductive, the grounding plug 23 only has a grounding function, that is, the electrostatic charge of the mosquito net body 1 is led into the ground, but the mosquito net body 1 is not conductive.

As an optional embodiment, as shown in FIG. 2, the grounding pin is a metal piece 231 or other conductive pieces. Both the live pin and the neutral pin are plastic pieces 232 or other non-conductive pieces.

Embodiment 2

The difference between this embodiment and the above embodiment is that the live pin, the neutral pin and the around terminal are separately provided. As shown in FIGS. 4-9, the grounding plug in the grounding connection device comprises a first plug part 2311 connected with the mosquito net body 1 and a second plug part 2312 adapted to sockets of different models, wherein:

a tab component 5 connected with a grounding pin or a grounding plate thereon via a wire is provided in the second plug part 2312, a jack 4 allowing the first plug part to be inserted is provided on the shell of the second plug part 2312, and the first plug part 2311 is capable of being electrically connected with the tab component 5 after being inserted into the jack 4.

Figure 4:
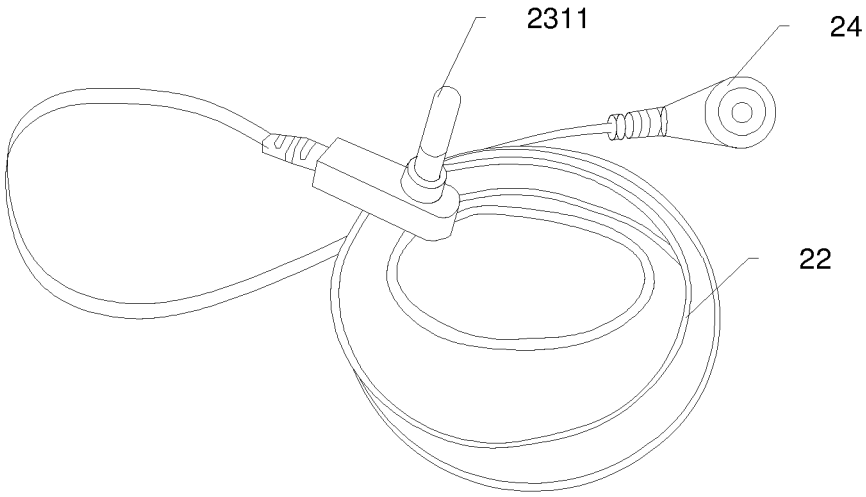
FIG. 4 is a schematic structural diagram of a first plug part.

As shown in FIG. 4, the first plug part 2311 is an American-standard plug. When it is necessary to use an American-standard socket, the first plug part 2311 can be used alone to cooperate with the socket lead the static electricity of the mosquito net, body into the ground.

The above second plug part 2312 can be plugs of various current standards, such as a European-standard plug, an English-standard plug, a Chinese-standard plug, etc., as shown in FIGS. 5-9. In this embodiment, a European-standard plug and an English-standard plug are illustrated as examples. Of course, the Chinese-standard plug (or plugs of other models) in the above embodiment 1 can also adopt the above structure, which will not be described in detail here.

Figure 5:
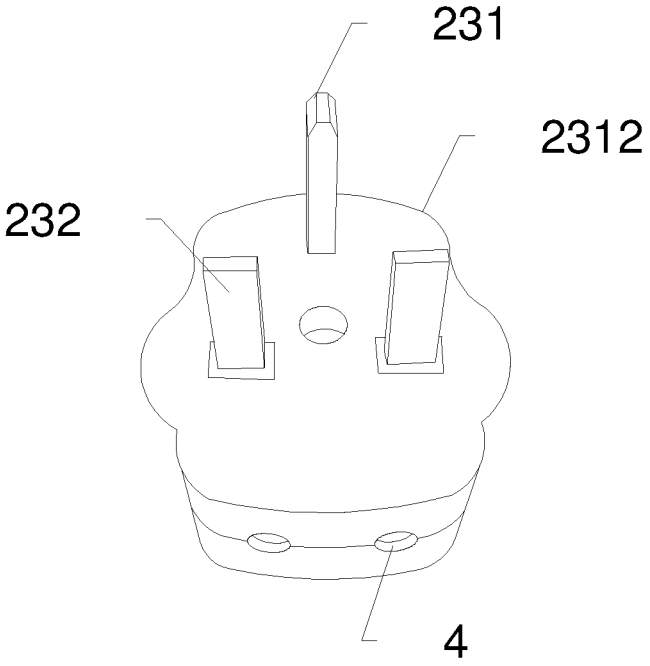
FIG. 5 is a schematic structural diagram of a first embodiment of a second plug part.

As shown in FIG. 5, as for the English-standard plug, each connection pin is as shown in FIG. 5, and the grounding pin made of metal piece 231 is provided at the position for grounding. In order to realize the cooperation between the first plug part 2311 and the second plug part 2312, a jack 4 is provided on the shell of the second plug part 2312. When the first plug part 2311 (an American-standard plug) is inserted into the jack 4, the first plug part 2311 can be connected with the tab component 5. However, since the tab component 5 is connected with the grounding pin on the second plug part 2312 (an English-standard plug) via wires, when the first plug part 2311 is inserted into the jack 4 on the second plug part 2312, the matching structure can be adapted to the English-standard socket, and the static electricity of the mosquito net body 1 is led into the ground.

Figure 7:
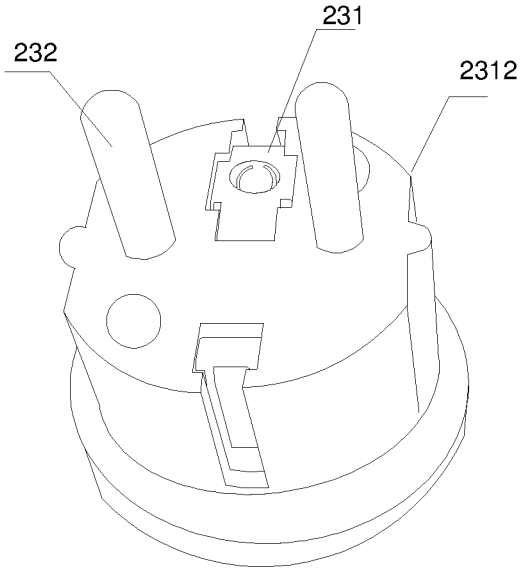
FIG. 7 is a schematic front structure diagram of a second embodiment of a second plug part.
Figure 8:
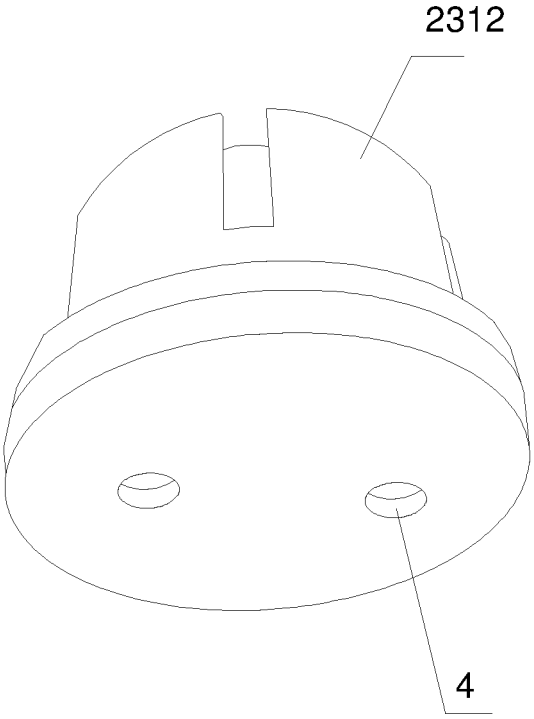
FIG. 8 is a schematic diagram structure of a second embodiment of a second plug part.

As shown in FIG. 7 and FIG. 8, as for the European-standard plug, the grounding pin made of metal piece 231 is provided at the position for grounding. The tab component 5 is connected with the grounding piece via wires. Similarly, a jack 4 is provided on the shell of the second plug part 2312 (a European-standard plug). When the first plug part 2311 (an American-standard plug) is inserted into the jack 4, the first plug part 2311 can be connected with the tab component 5. However, since the tab component 5 is connected with the grounding piece on the second plug part 2312 (a European-standard plug) via wires, when the first plug part 2311 is inserted into the jack on the second plug part 2312, the matching structure can be adapted to the European-standard socket, and the static electricity of the mosquito net body 1 is led into the ground.

Preferably, the grounding plug 23 in this embodiment includes a plurality of second plug parts of different models.

According to the structure, the first plug part can be selectively used or the first plug part and the second plug part can be matched, so that the anti-radiation mosquito net is suitable for sockets of different models in many countries.

As an optional embodiment, a plurality of jacks 4 are provided on the second plug part 2312, and all the jacks 4 are electrically connected with the tab component 5. With this structure, one second plug part 2312 can be connected with two first plug parts 2311 at the same time, that is, two mosquito net bodies 1 can be connected with one second plug part 2312 to lead static electricity into the ground, which saves cost and is convenient to use.

Figure 6:
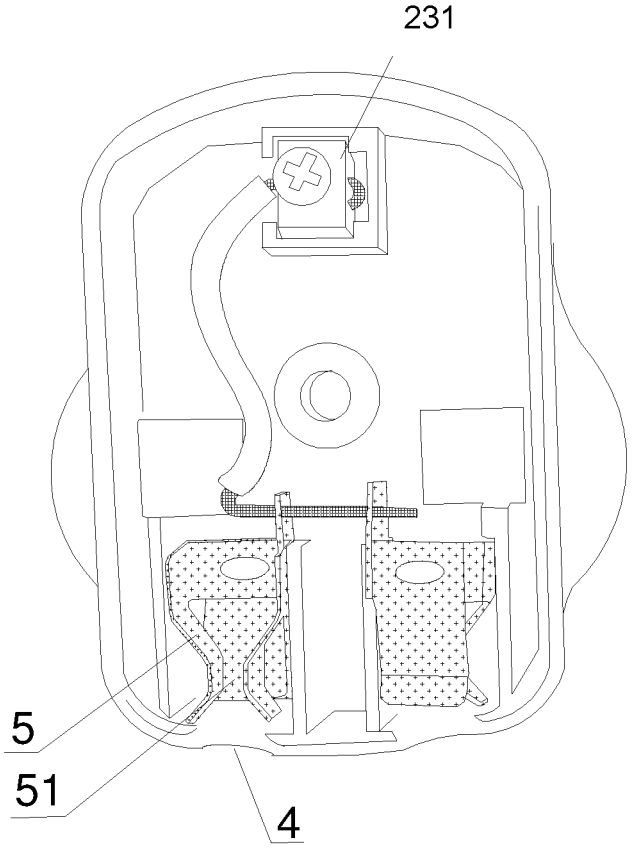
FIG. 6 is a schematic diagram of an internal structure of a first embodiment of a second plug part.
Figure 9:
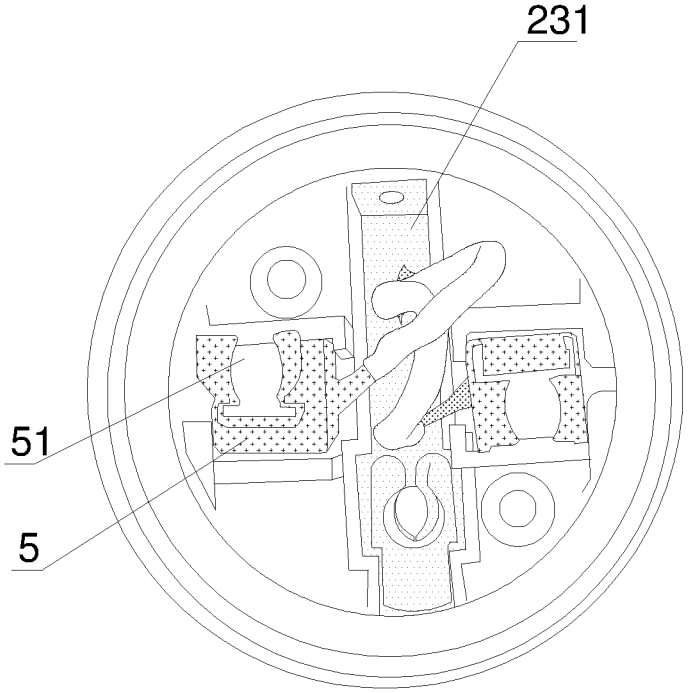
FIG. 9 is a schematic diagram of an internal structure of a second embodiment of a second plug part.

As shown in FIG. 6 and FIG. 9, the tab component 5 is located at a position corresponding to the jack 4 in the second plug part 2312, and an accommodation space 51 allowing the first plug part 2311 to extend is formed on the tab component 5.

When the conductive part of the first plug part 2311 is inserted into the accommodation space 51, the tab component 5 can clamp the conductive part of the first plug part 2311, preventing the first plug part 2311 from separating from the tab component 5, and ensuring the stability of the structure.

In order to facilitate better contact between the conductive gasket 21 and the mosquito net body 1, that is, to make the conductive second fastener 211 contact with the mosquito net body 1, as an optional embodiment, the conductive gasket 21 is made of soft conductive materials, so as to facilitate contact with the mosquito net body 1 and lead the static electric on the mosquito net body 1 to the ground through the conductive gasket 21, the connecting wire 22 and the grounding plug 23.

In order to facilitate the fixing of the conductive gasket 21 on the mosquito net body 1, as an optional embodiment, as shown in FIGS. 2 and 3, the conductive gasket 21 is fixedly clamped on the mosquito net body 1 by a fixing clip 25, or the conductive gasket 21 is directly sewed on the mosquito net body.

As an optional embodiment, the mosquito net body 1 is square or round. The specific shape of the mosquito net is not limited, and it can be square, round or in other shapes.

In the description of this specification, specific features, structures or characteristics may be combined in any one or more embodiments or examples in a suitable manner.

The above is only a specific embodiment of the present invention, but the protection scope of the present invention is not limited thereto. Any changes or substitutions conceivable to those familiar with the technical field within the technical scope disclosed by the present invention should be covered within the protection scope of the present invention. Therefore, the protection scope of the present invention shall be subject to the protection scope of the claims.

What is claimed is:

1. An anti-radiation mosquito net, comprising a mosquito net body and a grounding connection device, wherein the mosquito net body is made of silver fibers and has a dense mesh structure, the grounding connection device is connected with the mosquito net body, and the grounding connection device is connected with a socket to lead static electricity of the mosquito net body into the ground;

wherein the grounding connection device comprises a conductive gasket, a connecting wire and a grounding plug connected with the socket, wherein the conductive gasket is connected with the mosquito net body, and the connecting wire is detachably connected with the conductive gasket;

wherein the conductive gasket and the connecting wire are fastened and connected;

wherein a fixing part is provided at the connection between the connecting wire and the grounding plug, a first fasteners provided on the fixing part, a second fastener adapted to the first fastener is provided on the conductive gasket, and the first fastener and the second fastener can be fastened and fixed with each other and are made of conductive materials.

2. The anti radiation mosquito net according to claim 1, wherein a resistance device is provided on the connecting line.

3. The anti-radiation mosquito net according to claim 1, wherein the grounding connection device comprises a grounding plug for connecting the mosquito net body and the socket, and the grounding plug comprises a grounding terminal for grounding static electricity, and a live wire pin and a neutral wire pin made of non-conductive materials.

4. The anti-radiation mosquito net according to claim 1, wherein the grounding connection device comprises a first plug part connected with the mosquito net body and a second plug part adapted to sockets of different models, wherein:

a tab component connected with a grounding pin or a grounding plate thereon via a wire is provided in the second plug part, a jack allowing the first plug part to be inserted is provided on the shell of the second plug part, and the first plug part is capable of being electrically connected with the tab component after being inserted into the jack.

5. The anti-radiation mosquito net according to claim 4, wherein the first plug part is an American-standard plug, and the second plug part is one or more of a European-standard plug, an English-standard plug and a Chinese-standard plug.

6. The anti-radiation mosquito net according to claim 4, wherein a plurality of jacks are provided on the second plug part, and all the jacks are electrically connected with the tab component;

the tab component is located at a position corresponding to the jack in the second plug part, and an accommodation space allowing the first plug part to extend is formed on the tab component.

7. The anti-radiation mosquito net according to claim 1, wherein the conductive gasket is fixedly clamped on the mosquito net body by a fixing clip or sewed on the mosquito net body.

* * * * *